US008354935B2

(12) United States Patent
Rauworth

(10) Patent No.: US 8,354,935 B2
(45) Date of Patent: Jan. 15, 2013

(54) METHOD FOR HUSHING A CO DETECTOR THROUGH POWER-ON RESET

(75) Inventor: Timothy A. Rauworth, West Chicago, IL (US)

(73) Assignee: Honeywell International Inc., Morristown, NJ (US)

( * ) Notice: Subject to any disclaimer, the term of this patent is extended or adjusted under 35 U.S.C. 154(b) by 187 days.

(21) Appl. No.: 13/045,462

(22) Filed: Mar. 10, 2011

(65) Prior Publication Data

US 2012/0229286 A1 Sep. 13, 2012

(51) Int. Cl.
*G08B 17/10* (2006.01)

(52) U.S. Cl. ..... 340/632; 340/628; 340/629; 340/630; 340/522

(58) Field of Classification Search ..... 340/628–632, 340/514, 517, 521, 522, 577, 578, 587, 309.16; 250/339.03, 339.15
See application file for complete search history.

(56) References Cited

U.S. PATENT DOCUMENTS 6,166,647 A * 12/2000 Wong ..... 340/628
6,448,888 B1 * 9/2002 Horner et al. ..... 340/425.5
6,753,786 B1 * 6/2004 Apperson et al. ..... 340/628
6,873,254 B2 * 3/2005 Andres et al. ..... 340/521

* cited by examiner

*Primary Examiner* — Anh V La
(74) *Attorney, Agent, or Firm* — Husch Blackwell

(57) ABSTRACT

A method and apparatus is provided for activating a carbon monoxide detector. The method includes the steps of the carbon monoxide detector measuring a current carbon monoxide level, the carbon monoxide detector comparing the current carbon monoxide level with a first threshold value, determining whether the current carbon monoxide level exceeds the first threshold value, entering an alarm state upon detecting that the current carbon monoxide level exceeds the first threshold value after a first predetermined time period, determining from memory whether the carbon monoxide detector had previously been in an alarm state before activation and upon detecting that the current carbon dioxide level does not exceed the first threshold and the carbon monoxide detector was previously in the alarm state, resuming the alarm state after a second predetermined time period.

20 Claims, 2 Drawing Sheets

METHOD FOR HUSHING A CO DETECTOR THROUGH POWER-ON RESET

FIELD

The field of the invention relates to fire detection devices and more particularly to carbon monoxide detectors.

BACKGROUND

Devices for detecting fires are generally known. Smoke detectors are one example of such devices.

Fire detectors have found wide use in the home, office and industrial settings. As originally provided, most smoke detectors were battery powered with an audible alarm provided as an output to warn occupants of fires.

In the context of large buildings, including both offices and industrial setting, fire detection devices are connected to a central alarm panel. In this context, each of the fire detection devices is monitored by the central panel.

In addition to monitoring the fire detectors, the central panel may also activate visual and audible annunciators on or in the area of each of the devices. This is important were a fire is detected by a detector in one area, but it is important to provide a fire alert throughout the building or other protected areas in order to expedite the evacuation of the area.

More recently, municipalities have also begun to require the use of carbon monoxide detectors in buildings. This requirement has been motivated because improperly installed, maintained and/or ventilated fuel burning appliances can produce toxic carbon monoxide that cannot be detected through other means, such as smoke detectors.

However, carbon monoxide detectors do not operate the same way as smoke detectors. As such, carbon monoxide detectors cannot be mixed within a single standard zone type of an alarm system. Accordingly, a need exists for better ways of integrating the two technologies.

DETAILED DESCRIPTION

Figure 1:
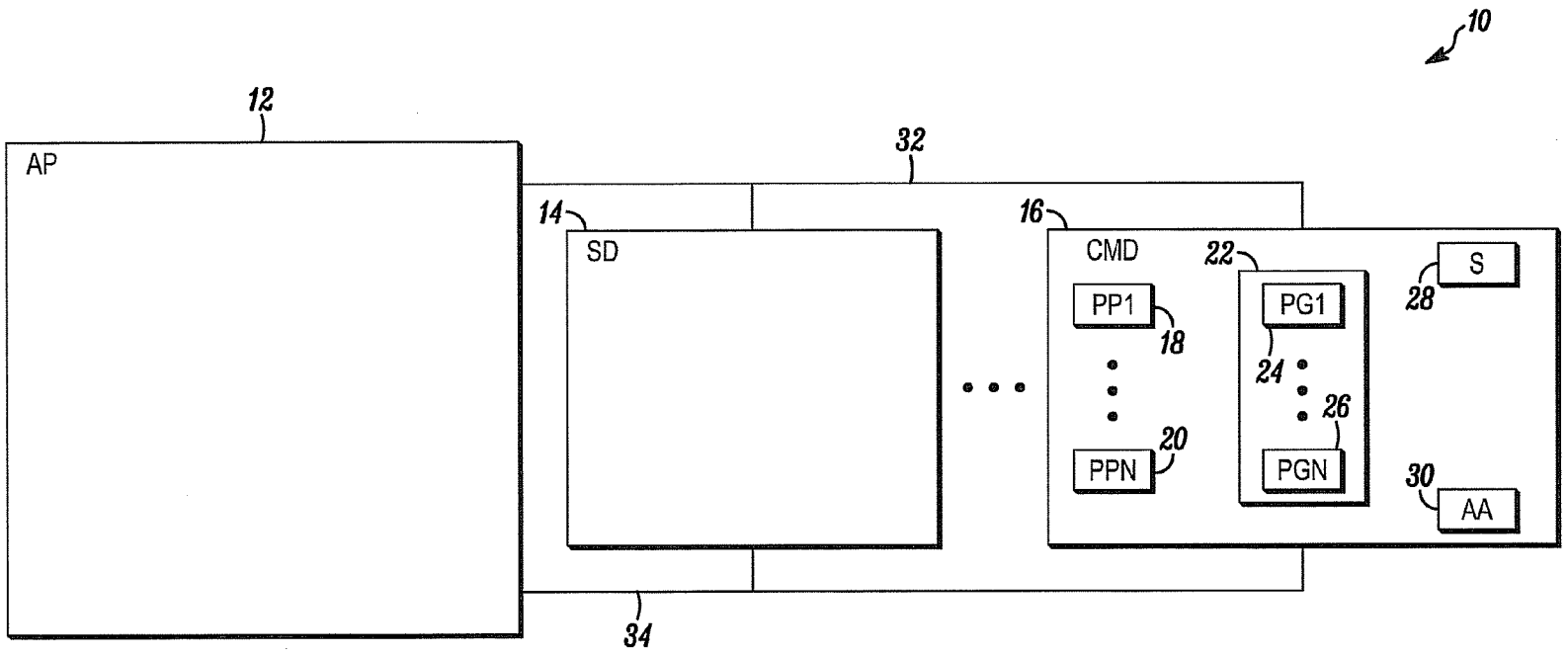
FIG. 1 is a block diagram of a fire alarm system in accordance with an illustrated embodiment of the invention.

FIG. 1 is block diagram of a fire detection system 10 shown generally in accordance with an illustrated embodiment of the invention. Included within the system 10 may be a control panel 12 and a number of fire detection devices 14, 16 that operate to detect fires within a protected area. The fire detection devices 14, 16 may include a mix of smoke detectors 14 and carbon monoxide detectors 16.

As shown in FIG. 1, the fire detection devices 14, 16 may be electrically coupled to the panel 12 by first and second conductors 32, 34. In the two wire system of FIG. 1, the two conductors 32, 34 function to supply power from the panel 12 to the detectors 14, 16 as well as couple alarm signals from the detectors 14, 16 back to the alarm panel 12.

One of the difficulties with prior art fire detection systems is that those systems could not easily mix smoke detectors and carbon monoxide detectors within a single zone. Carbon monoxide detectors and other types of fire detectors such as smoke detectors are generally not mixed in the same alarm zone because the information provided by each type of device represent a different type of risk and may be used differently in assessing danger.

Carbon monoxide detectors are required to indicate alarm at a threshold level of 10% COHb. This threshold is a function of time and concentration. Carbon monoxide detectors perform a very different function than smoke detectors. Because carbon monoxide detectors and smoke detectors perform different functions, and are required to send separate and distinct signals back to the control panel, they cannot be mixed within a single, conventional alarm zone connected to the alarm panel.

Because of the greater chance of false alarms, smoke detectors are not normally used with carbon monoxide detectors within the same zone in two-wire alarm systems. Smoke detectors are not normally used with carbon monoxide detectors in such cases because if an alarm is received, it may not be possible to determine if the detected event was based upon smoke or carbon monoxide.

Moreover, even if it can be determined that an alarm is based upon carbon monoxide, carbon monoxide is tasteless and odorless. In systems with many carbon monoxide detectors, it may not be possible to determine which carbon monoxide detector caused the alarm.

In order to address these issues, the system 10 uses carbon monoxide detectors 16 that can be reset from the central control panel 12 and that use a programmed delay upon reactivation that is dependent upon carbon monoxide levels. In this way it is possible to reduce or eliminate the difficulty in troubleshooting the sources of reported alarms in the system 10.

Included within the carbon monoxide detectors 16 may be one or more programmed processors 18, 20 operating under control of one or more programs 24, 26 loaded from a non-transitory computer readable medium (memory) 22. In this regard, a programmed, carbon monoxide detection processor 18, 20 may be programmed to continuously measure a carbon monoxide level via a carbon monoxide sensor 28. The carbon monoxide detection processor 18, 20 may integrate carbon monoxide readings over time based upon an appropriate time versus concentration process.

It should be noted that under this process, the carbon monoxide detection processor 18, 20 may simultaneously integrate on a number of different concentration levels in order to eventually issue a carbon monoxide alarm to the panel 12. The carbon monoxide detector 16 may transmit the signal to the alarm panel 12 by pulling or otherwise clamping the supply voltage imposed on conductors 32, 34 by the alarm panel down to a predetermined value as an indication of the alarm state.

For example, the carbon monoxide detection processor may include a number of carbon monoxide concentration levels (e.g., a, b, c, where a>b>c) and a respective threshold time value (e.g., d, e, f) associated with each level, where the time value (e.g., d) associated with concentration level a is much shorter than the time value (e.g., e) associated with concentration level b which is, in turn, shorter than the time value (e.g., f) associated with concentration level c.

For example, if the concentration level should exceed level c, then a first integrator may integrate on the longest level c. If the concentration should then exceed level b, then a second integrator begins to integrate on the second level b at the same time as the first integrator continues to integrate on the first level c.

Each of the integrators has a threshold time associated with the integrator. In the above example, if the concentration level should fall below concentration level b before the second integrator goes into alarm, then the second integrator is reset. Should the concentration level remain above c, then the first integrator continues to integrate. If the first integrator reaches the time threshold level associated with concentration level c without the concentration level falling below c, then the first integrator sends an alarm message to a programmed alarm processor 18, 20. The alarm processor 18, 20 sends an alarm to the alarm panel 12.

Upon receipt of an alarm, the alarm panel 12 may issue an audible alarm through an audible alarm transducer 30. The audible transducer 30 may be coupled across the conductors 32, 34 or be located inside one or more of the fire detectors 14, 16.

To activate the alarm transducer, the panel 12 may remove and reverse the voltage imposed on the conductors 32, 34. For example, the voltage imposed on the conductors may be some appropriate supply voltage (e.g., 12 volts). To activate the alarm transducers 30, the alarm panel may remove the imposed voltage of 12 volts and re-impose a reverse voltage of −12 volts.

The removal of the imposed supply voltage (and the re-imposing of the reverse voltage) functions to temporarily deactivate the carbon monoxide detectors 16. However before complete deactivation, a programmed deactivation processor 18, 20 detects the falling supply voltage and performs a number of steps before the deactivation processor 18, 20 is rendered inoperative by the declining voltage. For example, the deactivation processor 18, 20 saves a set of operating parameters present within the carbon monoxide detector 16 at the instant of shut down within memory 22. Once of the parameters saved is whether or not the carbon monoxide detector 16 was in an alarm state at shut down. Other parameters saved include the time values of each integrator at that instant.

The alarm transducers 30 may continue to sound until it is reset by a human operator through a reset button on the panel 12. Upon activation of the reset button, the alarm panel may impose the normal operating voltage on the conductors 32, 34 to reactivate the fire detectors 14, 16.

Upon reactivation of the carbon monoxide detector 16, a programmed start up processor 16, 18 retrieves the previous operating parameters from memory 22. The start up processor 16, 18 may also follow a set of start up steps 100 shown in FIG. 2.

A first step 102 performed during power on reset is to reinitialize the programmed processors 18, 20. The second step 102 is to read a current carbon monoxide (CO) level from the sensor 28.

A third step 106 performed by the start up processor 18, 20 is to compare the current CO reading with a first start up threshold (e.g., 350 ppm). If the current CO reading exceeds the start up threshold, then the start up processor may activate a timer associated with the start up threshold. Associated with the timer and start up threshold may be a start up delay that is independent of any time values discussed above in conjunction with the integrators. At the end of the start up delay, if the current CO reading is above the start up threshold, then the CO detector 16 automatically re-enters 108 the alarm mode.

On the other hand, if the start up processor 18, 20 determines that the current CO reading is less than the start up threshold, then the start up processor 18, 20 retrieves 110 the previous set of operating parameters saved in memory 22. Next, the start up processor 18, 20 determines 112 whether the CO detector 16 was in an alarm state during the previous shut down.

If the CO detector 16 was not in an alarm state before the previous deactivation, then the start up processor 16, 18 restarts 114 the integrators using the previous readings (e.g., integrator time values) that had been saved during shut down. This causes the CO detector 16 to continue operating as if the CO detector 16 had not been shut down.

On the other hand, if the detector 16 had been in an alarm state during the previous deactivation, then the start up processor 18, 20 activates a second start up timer that retards 116 re-entry of the CO detector 16 into the alarm state. Associated with the second start up time may be a fixed time period that allows time for a human operator of the system 10 to clear the alarm (e.g., by opening windows, doors, etc.). Alternatively, the fixed time period may be obtained by resetting the time periods associated with each of the integrators.

Figure 2:
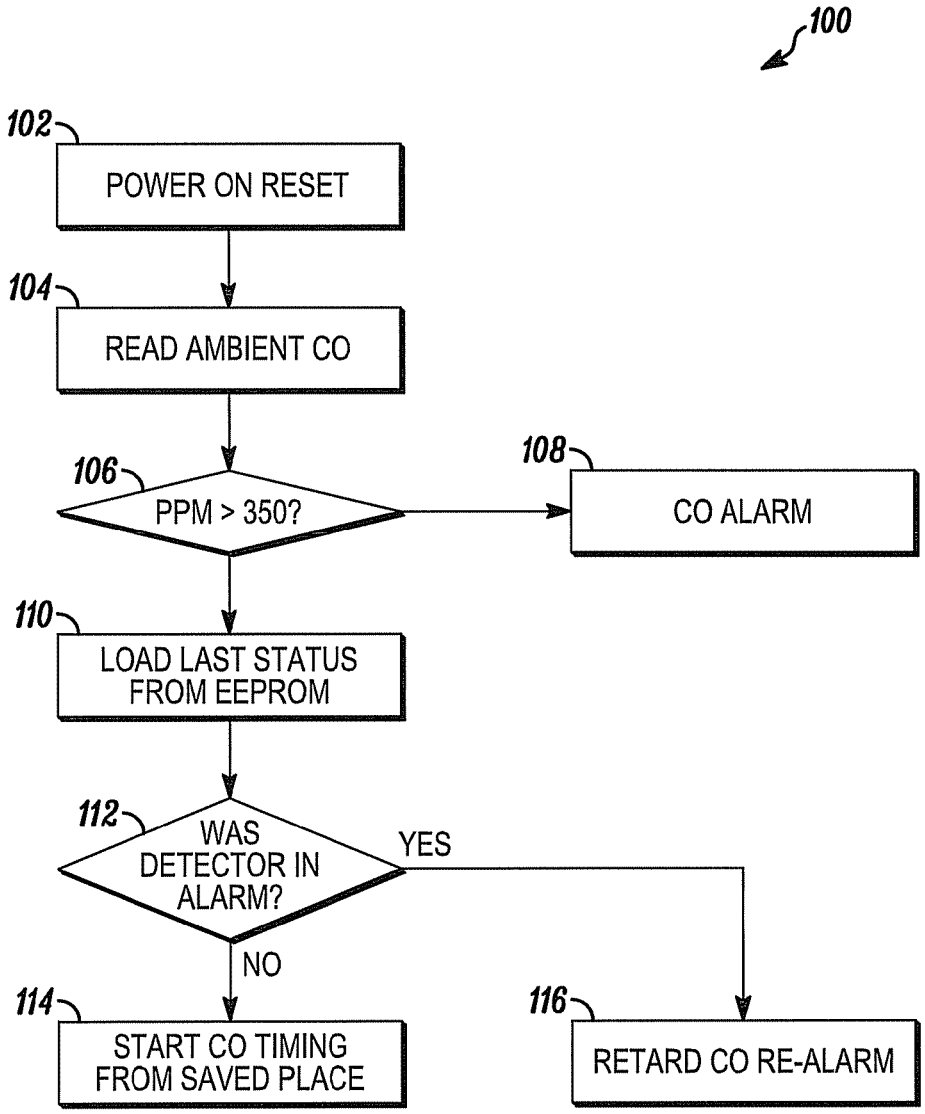
FIG. 2 is a set of start up steps that may be performed by the carbon monoxide detectors of FIG. 1.

In general, the process of FIG. 2 provides a method for resetting the CO detectors 16 of the system 10 without retrofitting the panel 12 with additional software that would otherwise be required by CO detectors 16. This allows the CO detectors 16 to be easily added to existing system 10 without concern for the difficulty associated with resetting most CO detectors.

A specific embodiment of method and apparatus for incorporating carbon monoxide detectors into fire systems has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method comprising:

activating a carbon monoxide detector;

the carbon monoxide detector measuring a current carbon monoxide level;

the carbon monoxide detector comparing the current carbon monoxide level with a first threshold value;

determining whether the current carbon monoxide level exceeds the first threshold value;

entering an alarm state upon detecting that the current carbon monoxide level exceeds the first threshold value after a first predetermined time period;

determining from memory whether the carbon monoxide detector had previously been in an alarm state before activation; and upon detecting that the current carbon dioxide level does not exceed the first threshold and the carbon monoxide detector was previously in the alarm state, resuming the alarm state after a second predetermined time period.

2. The method of claim 1 further comprising upon detecting that the current carbon monoxide level does not exceed the first threshold level and the carbon monoxide detector was not previously in the alarm state, re-initiating a carbon monoxide versus time alarm detection process as if a shut down had not occurred.

3. The method as in claim 1 further comprising the carbon monoxide detector detecting a removal of power and saving a set of current operating parameters including at least an alarm state before shutting down.

4. The method as in claim 1 further comprising coupling the carbon monoxide detector to an alarm panel through a set of first and second conductors.

5. The method as in claim 4 further comprising the alarm panel imposing a voltage on the set of first and second conductors.

6. The method as in claim 5 further comprising the carbon monoxide detector transmitting an alarm state signal to the alarm panel through the first and second conductors upon entering the alarm state.

7. The method as in claim 6 wherein the transmitted alarm signal further comprises the carbon monoxide detector pulling the imposed voltage down to a predetermined voltage as an indication of the alarm state.

8. The method of claim 5 further comprising the alarm panel deactivating the carbon monoxide detector by removing the imposed voltage from the set of first and second conductors.

9. A method comprising:

removing power from a power supply connection of a carbon monoxide detector;

the carbon monoxide detector detecting the removal of power and saving a current set of operating parameters before shutting down in response to the power removal;

activating the carbon monoxide detector after the shut down by resupplying power to the carbon monoxide detector;

the carbon monoxide detector measuring a current carbon monoxide level;

the carbon monoxide detector comparing the current carbon monoxide level with a first threshold value and upon detecting the current carbon monoxide level exceeds the first threshold value entering an alarm state after a first predetermined time period;

the carbon monoxide detector retrieving the saved set of operating parameters and determining whether the carbon monoxide detector was in an alarm state before shut down;

upon detecting that the current carbon monoxide level does not exceed the first threshold level and determining that the carbon monoxide detector was in the alarm state before shut down, delaying re-initiation of the alarm state by a second predetermined time period; and upon detecting that the current carbon monoxide level does not exceed the first threshold level and determining that the carbon monoxide detector was not in the alarm state before shut down, re-initiating a carbon monoxide versus time alarm detection process as if the shut down had not occurred.

10. The method as in claim 1 further comprising coupling the carbon monoxide detector to an alarm control panel via first and second conductors.

11. The method as in claim 10 further comprising supplying power to the carbon monoxide detector from the alarm control panel via first and second conductors.

12. The method as in claim 1 further comprising resetting the carbon monoxide detector via the alarm control panel removing the supplied power to the carbon monoxide detector.

13. A system comprising:

a carbon monoxide detector;

a programmed processor within the carbon monoxide detector that measures a current carbon monoxide level;

a programmed processor within the carbon monoxide detector that compares the current carbon monoxide level with a first threshold value;

a programmed processor within the carbon monoxide detector that determines whether the current carbon monoxide level exceeds the first threshold value;

a programmed processor within the carbon monoxide detector that causes the carbon monoxide detector to enter an alarm state upon detecting that the current carbon monoxide level exceeds the first threshold value after a first predetermined time period;

a programmed processor within the carbon monoxide detector that determines from memory whether the carbon monoxide detector had previously been in an alarm state before activation; and a programmed processor within the carbon monoxide detector that upon detecting that the current carbon dioxide level does not exceed the first threshold and the carbon monoxide detector was previously in the alarm state, causes the carbon monoxide detector to resume the alarm state after a second predetermined time period.

14. The system of claim 13 further comprising a programmed processor within the carbon monoxide detector that upon detecting that the current carbon monoxide level does not exceed the first threshold level and the carbon monoxide detector was not previously in the alarm state, causes the carbon monoxide detector to re-initiate a carbon monoxide versus time alarm detection process as if a shut down had not occurred.

15. The system as in claim 13 further comprising a programmed processor within the carbon monoxide detector that detects a removal of power and saving a set of current operating parameters including at least an alarm state before shutting down.

16. The system as in claim 13 further comprising an alarm panel coupled to the carbon monoxide detector through a set of first and second conductors.

17. The system as in claim 16 further comprising the alarm panel imposing a voltage on the set of first and second conductors.

18. The system as in claim 17 further comprising the carbon monoxide detector transmitting an alarm state signal to the alarm panel through the first and second conductors upon entering the alarm state.

19. The system as in claim 18 wherein the transmitted alarm signal further comprises the carbon monoxide detector pulling the imposed voltage down to a predetermined voltage as an indication of the alarm state.

20. The system of claim 17 further comprising the alarm panel deactivating and resetting the carbon monoxide detector by removing the imposed voltage from the set of first and second conductors.

* * * * *